US007424840B1

(12) United States Patent
Huang

(10) Patent No.: US 7,424,840 B1
(45) Date of Patent: Sep. 16, 2008

(54) NAIL GUN

(76) Inventor: Shu-Chung Huang, 235 Chung-Ho Box 8-24, Taipei (TW)

( * ) Notice: Subject to any disclaimer, the term of this patent is extended or adjusted under 35 U.S.C. 154(b) by 61 days.

(21) Appl. No.: 11/710,635

(22) Filed: Feb. 26, 2007

(51) Int. Cl.
*B25B 23/04* (2006.01)
*B25F 5/00* (2006.01)

(52) U.S. Cl. ..... 81/435; 81/57.37

(58) Field of Classification Search ..... 81/435, 81/434, 57.37
See application file for complete search history.

(56) References Cited

U.S. PATENT DOCUMENTS 5,083,483 A * 1/1992 Takagi ..... 81/434
6,701,811 B1 * 3/2004 Chang et al. ..... 81/434
7,121,174 B2 * 10/2006 Lai et al. ..... 81/434
7,231,854 B2 * 6/2007 Kikuchi ..... 81/434

* cited by examiner

*Primary Examiner*—David B Thomas

(57) ABSTRACT

A nail gun with an improved nail-belt transmission mechanism that comprises a ratchet wheel coupled to a transmission gear wheel through a transmission axle. One end of the transmission axle is provided with a link capable of driving the first ratchet wheel by a second ratchet wheel mounted on the inner wall aside the transmission gear wheel. There is a retaining part engaged with the second ratchet wheel from above for maintaining equal-pace rotation of the transmission gear wheel, thereby facilitating screw nail mounting by the nail gun.

1 Claim, 13 Drawing Sheets

NAIL GUN

FIELD OF THE INVENTION

The present invention relates to nail guns, more particularly to a nail gun with an improved nail-belt transmission mechanism for facilitating screw mounting.

BACKGROUND OF THE INVENTION

Referring to FIG. 1, a nail gun of the prior art comprises an electrical or gas driver 10 and a nail feeder 20 mounted in the front of the driver 10. The nail feeder 20 further comprises a guide mount 21, a slide head 22, a compressional spring 23, a nail-belt transmission mechanism 24 and an adjustment bracket 25.

As shown in FIG. 3, the guide mount 21 further comprises a left half 21A and a right half 21B, whereby they can sandwich the front end of the driver 10 when they are coupled. The inner wall of the left half 21A is provided with a guide slot 211 having a horizontal section and a sloppy section.

As shown in FIG. 3, the slide head 22 is slidably housed within the guide mount 21, which consists of a left half 22A and a right half 22B. The outer wall of the left half 22A is provided with a guide slot 221 taking the shape of an arc.

As shown in FIG. 3, the compressional spring 23 is mounted between the slide head 22 and the guide mount 21 for exerting an outward pushing force on the slide head 22.

As shown in FIG. 2, the nail-belt transmission mechanism 24 is housed within the slide head 22, which comprises a transmission gear wheel 241, a ratchet wheel 247 and a retaining part 248. The transmission gear wheel 241 has an axial hole 242 provided with an unidirectional control unit 243. The unidirectional control unit 243 is a unidirectional bearing set and coupled with a transmission axle 244 going through the axial hole 242, whereby the transmission axle 244 can rotate only in the clockwise direction. The outer end of the transmission axle 244 is provided with a link 245 whose other end is provided with an axle 246 that bulges out of the guide slot 221 on the left half 22A. The axle 246 is further extended into the guide slot 211 on the left half 21A when the guide mount 21 and the slide head 22 are coupled. Moreover, the ratchet wheel 247 is mounted on the inner wall of the right half 22B of the slide head 22. The retaining part 248, being a spring with an arm, is mounted on the same wall for assuring an equal-pace and unidirectional rotation of the ratchet wheel 247 and the transmission axle 244 only in the counter-clockwise direction.

As shown in FIG. 1, the adjustment bracket 25 is mounted in the front of the slide head 22 for adjusting the spacing between the adjustment bracket 25 and the slide head 22 for accommodating nails of different lengths.

As shown in FIG. 4, to use the nail gun, the slide head 22 is pushed against a wall and therefore retract into the guide mount 21, whereby the axle 246 in the nail-belt transmission mechanism 24 slides along the guide slots 211 and 221. The link connected to the transmission axle 244 rotates within the unidirectional bearing set in the clockwise sense. At the same time, the retaining spring 248 is tilted against the ratchet wheel 247, and therefore the transmission gear wheel 241 and the ratchet wheel 247 will not rotate accordingly. Whereby, the driver 10 will lock on a screw nail. When the slide head 22 is released, the compressional spring 23 will slide along the guide mount 21, driving a backward slide of the axle 246 along the guide slots 211 and 221 and then causing the transmission axle 244 to rotate in the counter-clockwise sense. However, since the transmission axle 244 rotate in the clockwise sense within the bearing set, the transmission axle 244 will drive the transmission gear wheel 241 and the ratchet wheel 247 instead. Further, because of the engagement between the retaining spring 248 and the ratchet wheel 247, the counter-clockwise rotation is step by step with a fixed spacing. As shown in FIG. 3, the nail belt 30 can feed nails by the counter-clockwise jump of the transmission gear wheel. The adjustment bracket 25 is mounted in the front of the slide head 22 for adjusting the spacing between the adjustment bracket 25 and the slide head 22 for accommodating nails of different lengths.

However, the nail of the prior art has the following disadvantages.

(1) Since the nail-belt transmission mechanism 24 is realized by a counter-clockwise, equal-spacing jumped rotation of the transmission gear wheel 241 driven by a unidirectional bearing set, the slide head 22 has to retract into the guide mount 21 for a fixed distance. Uneven pushing of the slide head 22 may lead to uneven transmission of the nail belt, causing jamming of nail gun.

(2) As shown in FIG. 5, the retaining spring 248 within the nail-belt transmission mechanism 24 may run into material fatigue after repetitious uses.

SUMMARY OF THE INVENTION

Accordingly, the primary objective of the present invention is to provide a nail gun having an improved nail-belt transmission mechanism for easier and more precise screw nail mounting.

To achieve above object, the present invention provides a nail gun, comprising: a guide mount consisting of a left half and a right half capable of being locked on a front terminal of a gas/electricity powered driver, said left half being further provided with a guide slot; a slide head slidably housed with in said guide mount and consisting of a left half and a right half, said left half being further provided with a guide slot; a compressional spring disposed between said guide mount and said slide head for exerting a forward force on said slide head; a nail-belt transmission mechanism further comprising a transmission gear wheel with an axial hole, a transmission axle inserted through said axial hole with a link on one end thereof, a first unidirectional ratchet wheel attached on a lateral wall by said transmission gear wheel and a retaining part downwardly interfering with said ratchet wheel, a free end of said link being further provided with an axle, a second unidirectional ratchet wheel being attached on another lateral wall close to the end of said transmission axle where said link and is connected, said first and said second unidirectional ratchet wheels being in corresponding positions; and an adjustment bracket mounted in a front end of said slide head for adjusting the spacing between said adjustment bracket and said slide head for accommodating nails of different lengths; whereby a nail belt will be fed into said driver smoothly.

DETAILED DESCRIPTION OF THE PREFERRED EMBODIMENTS

The various objects and advantages of the present invention will be more readily understood from the following detailed description when read in conjunction with the appended drawings.

Figure 1:
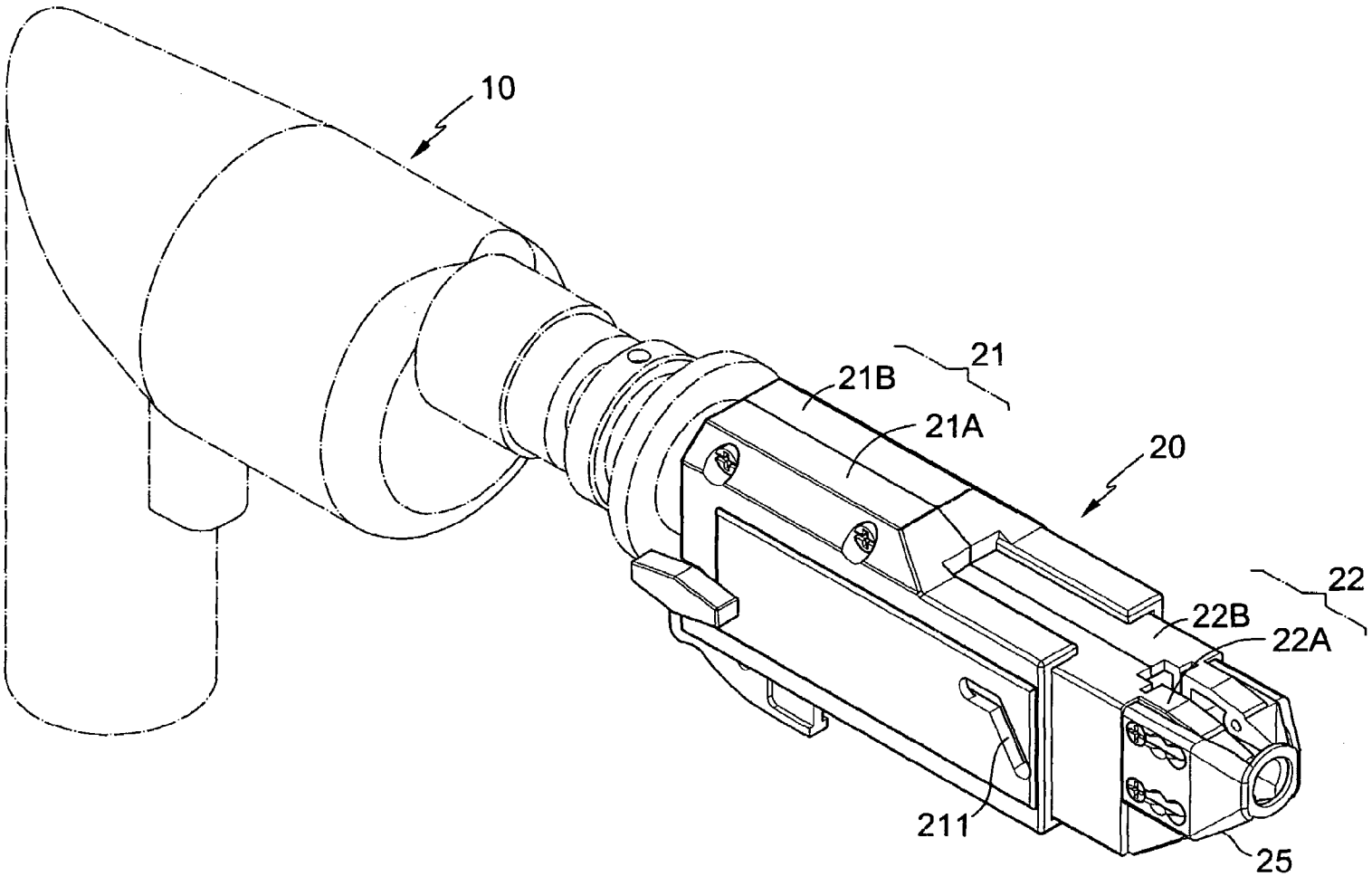
FIG. 1 is a perspective view of a nail gun of the prior art.
Figure 2:
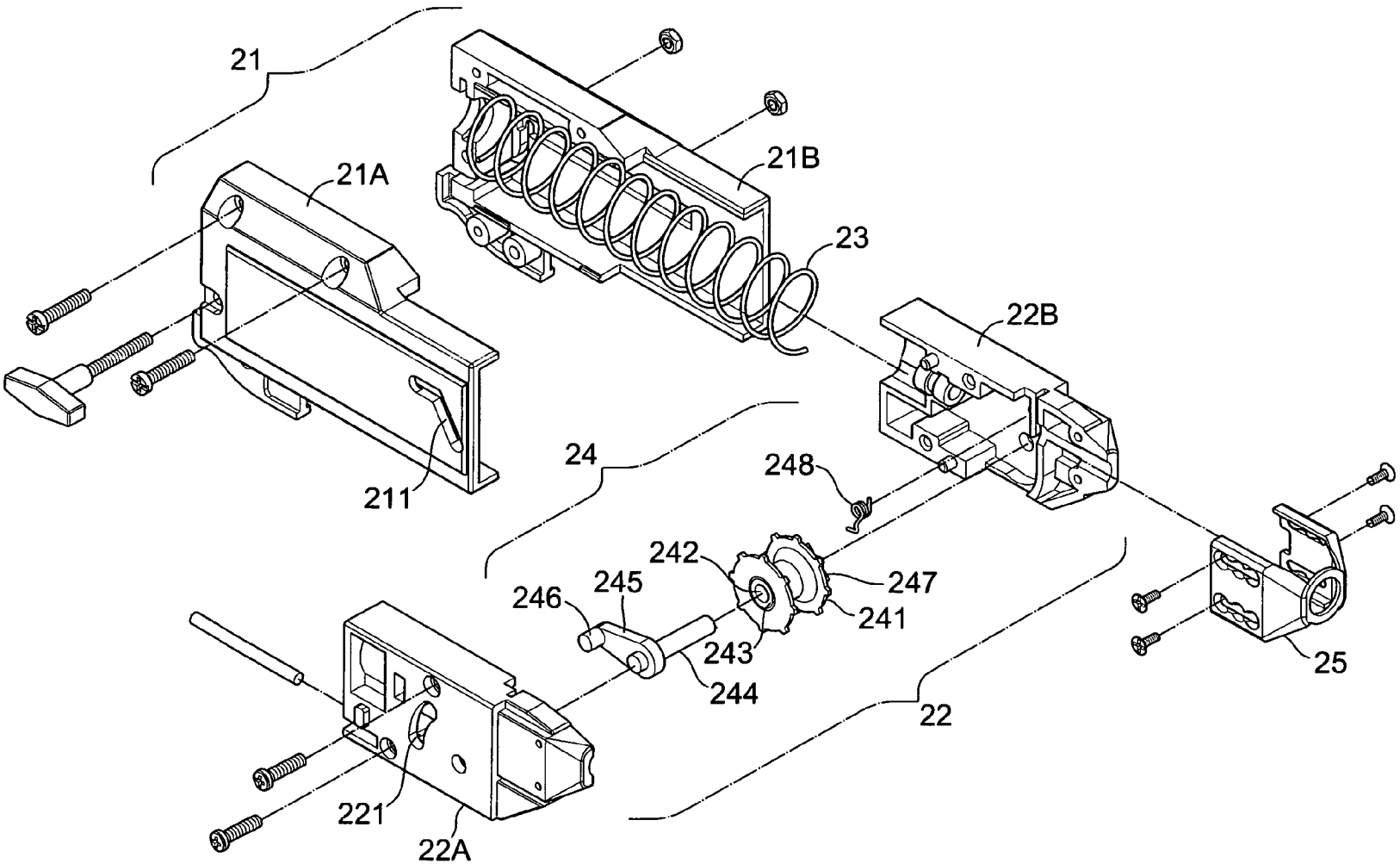
FIG. 2 is an exploded perspective view of the nail gun in FIG. 1.
Figure 3:
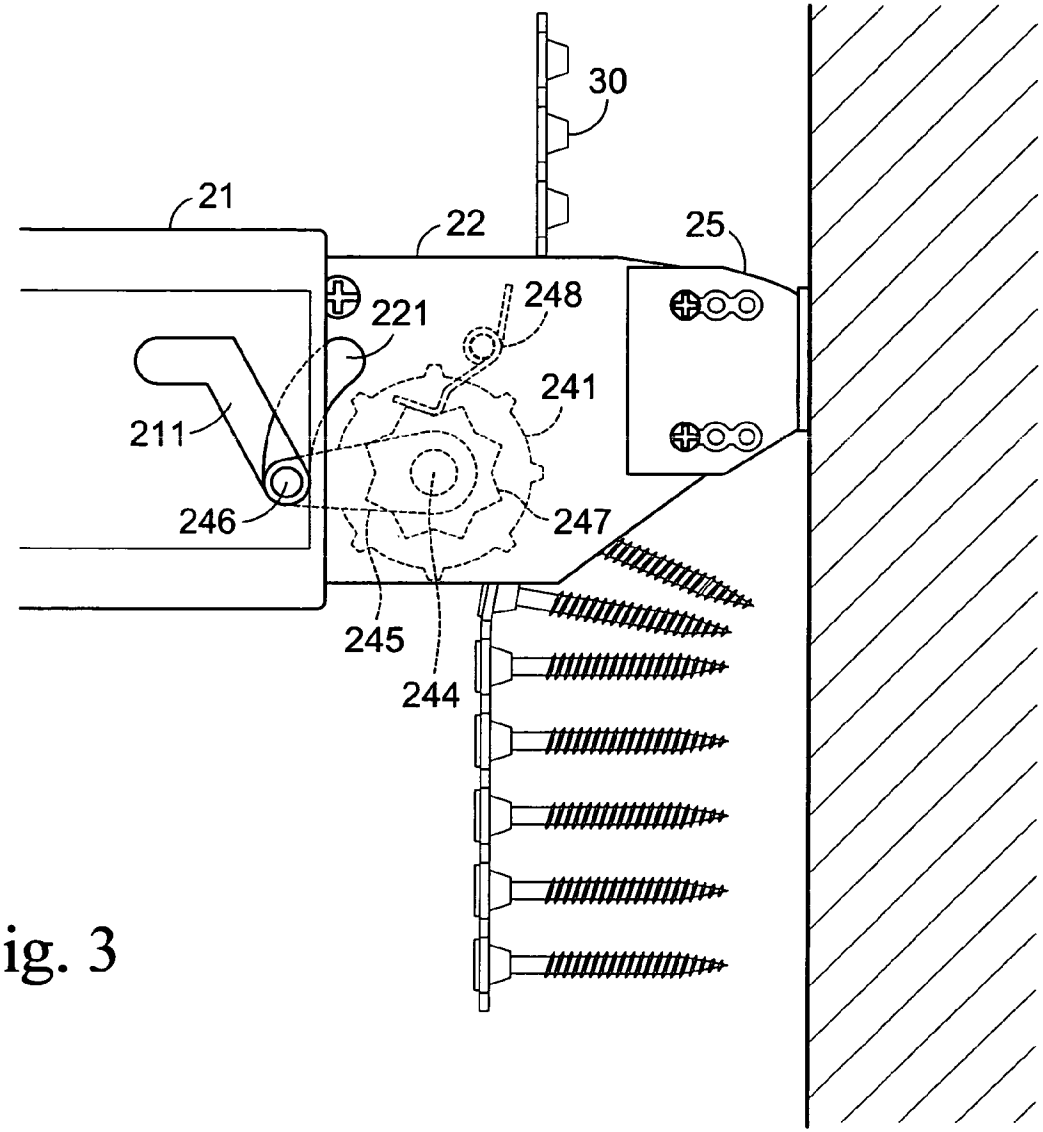
FIG. 3 is a cross-sectional view of the nail gun in FIG. 1, wherein the slide head (22) is not pressed.
Figure 4:
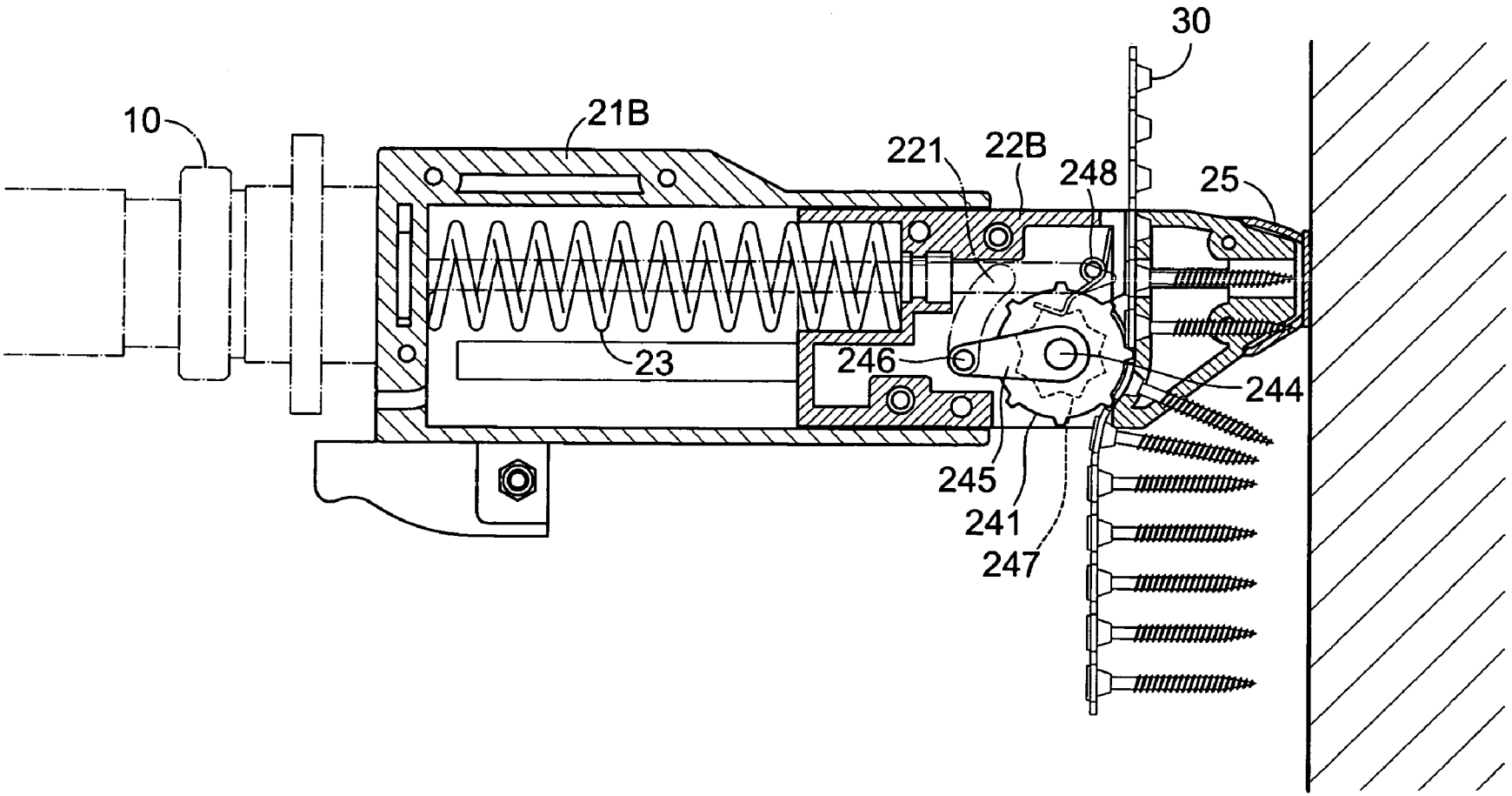
FIG. 4 is a cross-sectional view of the nail gun in FIG. 1, wherein the slide head (22) is pressed so that it retracts toward the guide mount (21).
Figure 5:
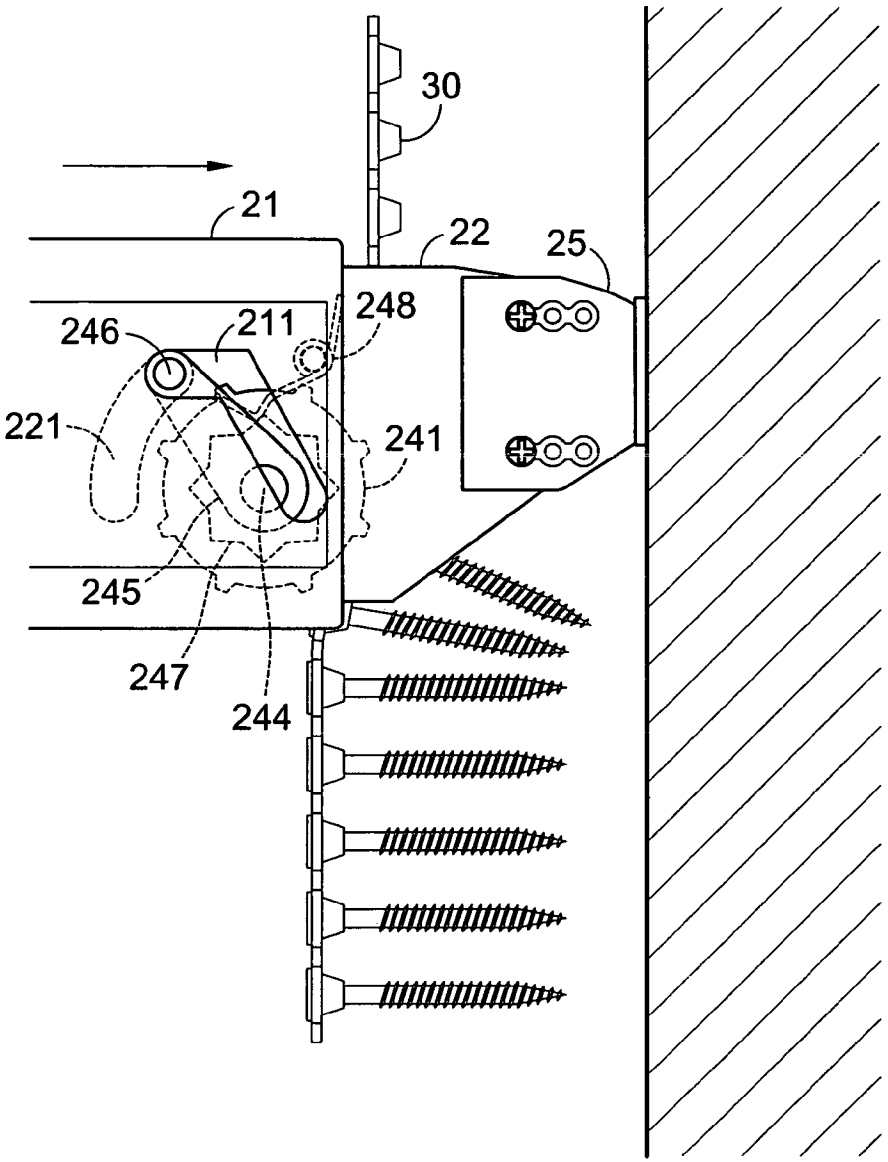
FIG. 5 is a cross-sectional view showing the configuration including the transmission gear wheel (241), the ratchet wheel (247) and the retaining part (248) of the nail gun in FIG. 1, wherein the slide head (22) is not pressed.
Figure 6:
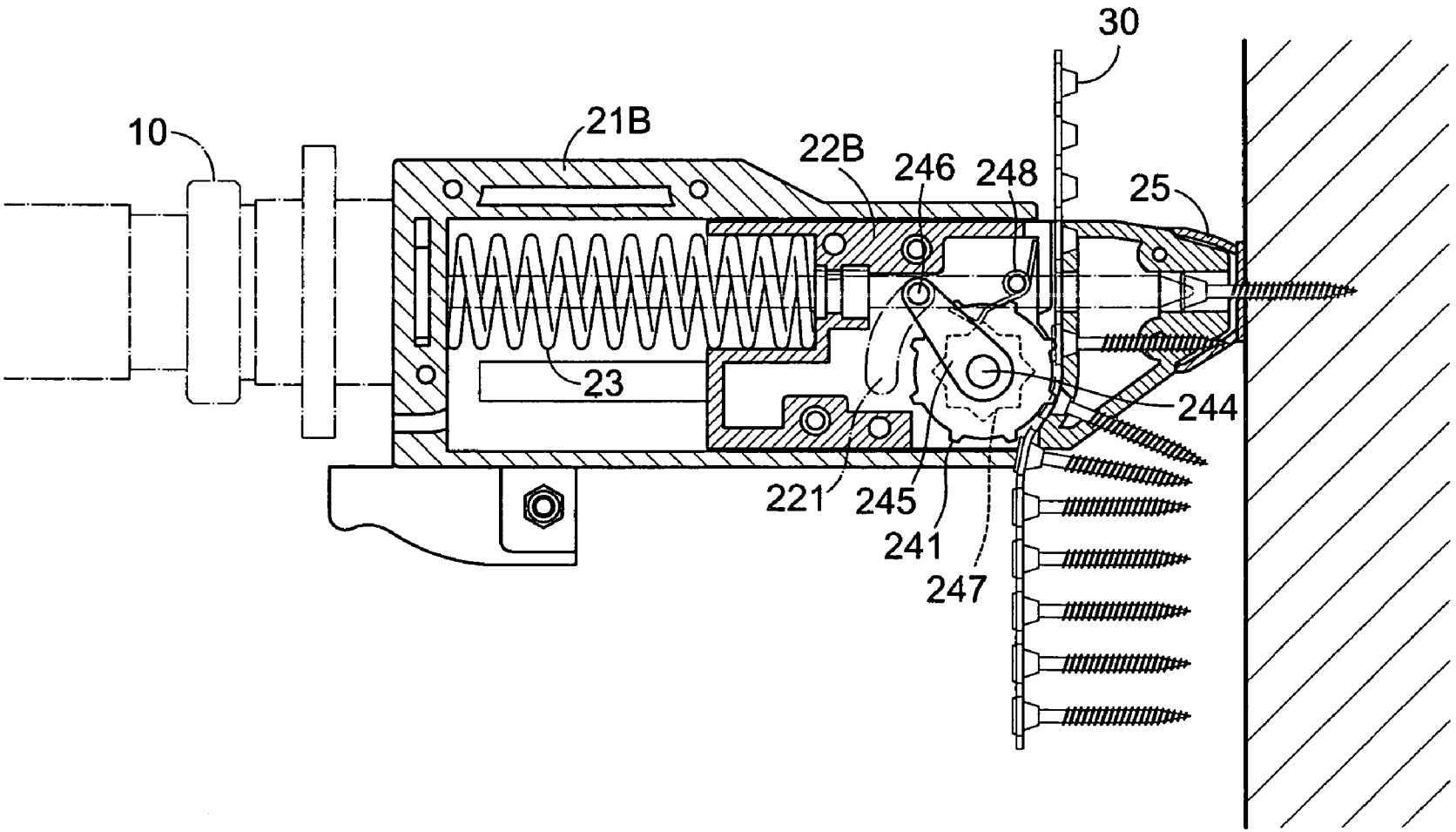
FIG. 6 is a cross-sectional view showing the configuration including the transmission gear wheel (241), the ratchet wheel (247) and the retaining part (248) of the nail gun in FIG. 1, wherein the slide head (22) is pressed.
Figure 7:
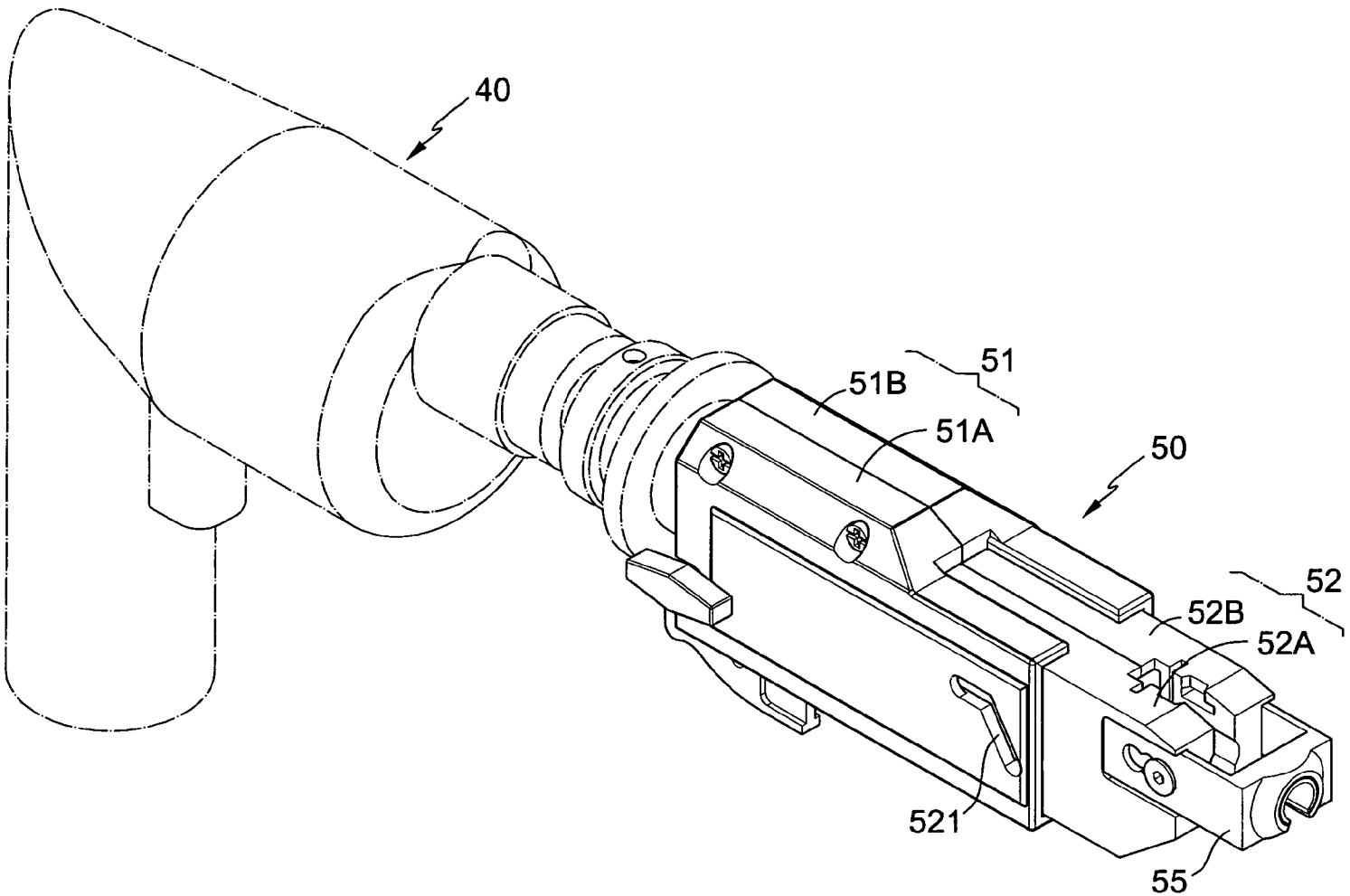
FIG. 7 is a perspective view of a nail gun of the present invention.

Referring to FIG. 7, the first preferred embodiment of the present invention as a nail gun comprises an electrical or gas driver 40 and a nail feeder 50 mounted in the front of the driver 40. The nail feeder 50 further comprises a guide mount 51, a slide head 52, a compressional spring 53, a nail-belt transmission mechanism 54 and an adjustment bracket 55.

Figure 10:
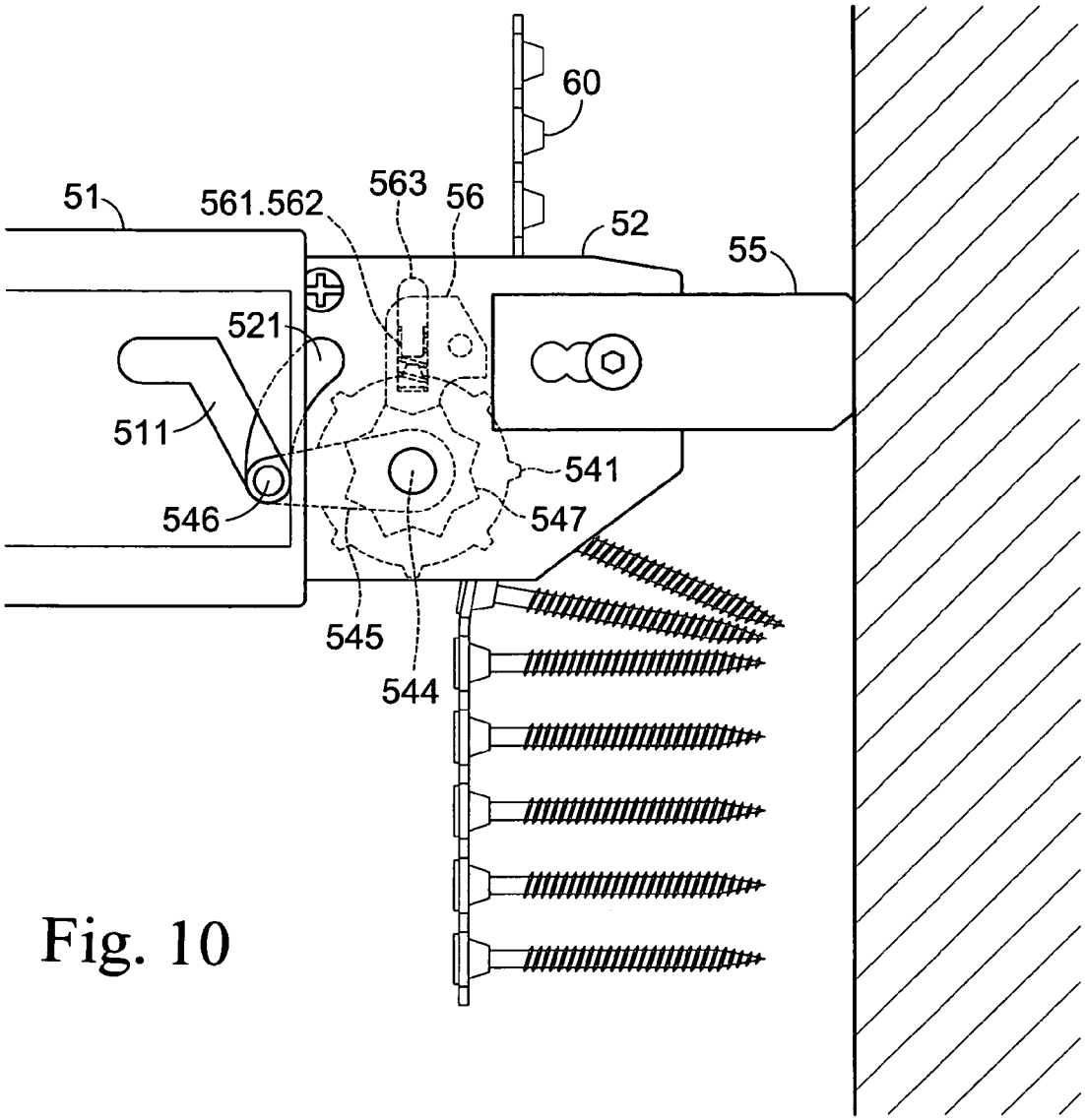
FIG. 10 is a cross-sectional view of the nail gun in FIG. 1, wherein the slide head (52) is pressed so that it retracts toward the guide mount (51).

As shown in FIG. 10, the guide mount 51 further comprises a left half 51A and a right half 51B, whereby they can hold the front end of the driver 40 when they are coupled. The inner wall of the left half 51A is provided with a guide slot 511 having a horizontal section and a sloppy section.

As shown in FIG. 10, the slide head 52 is slidably housed within the guide mount 51, which consists of a left half 52A and a right half 52B. The outer wall of the left half 52A is provided with a guide slot 521 taking the shape of an arc.

Figure 9:
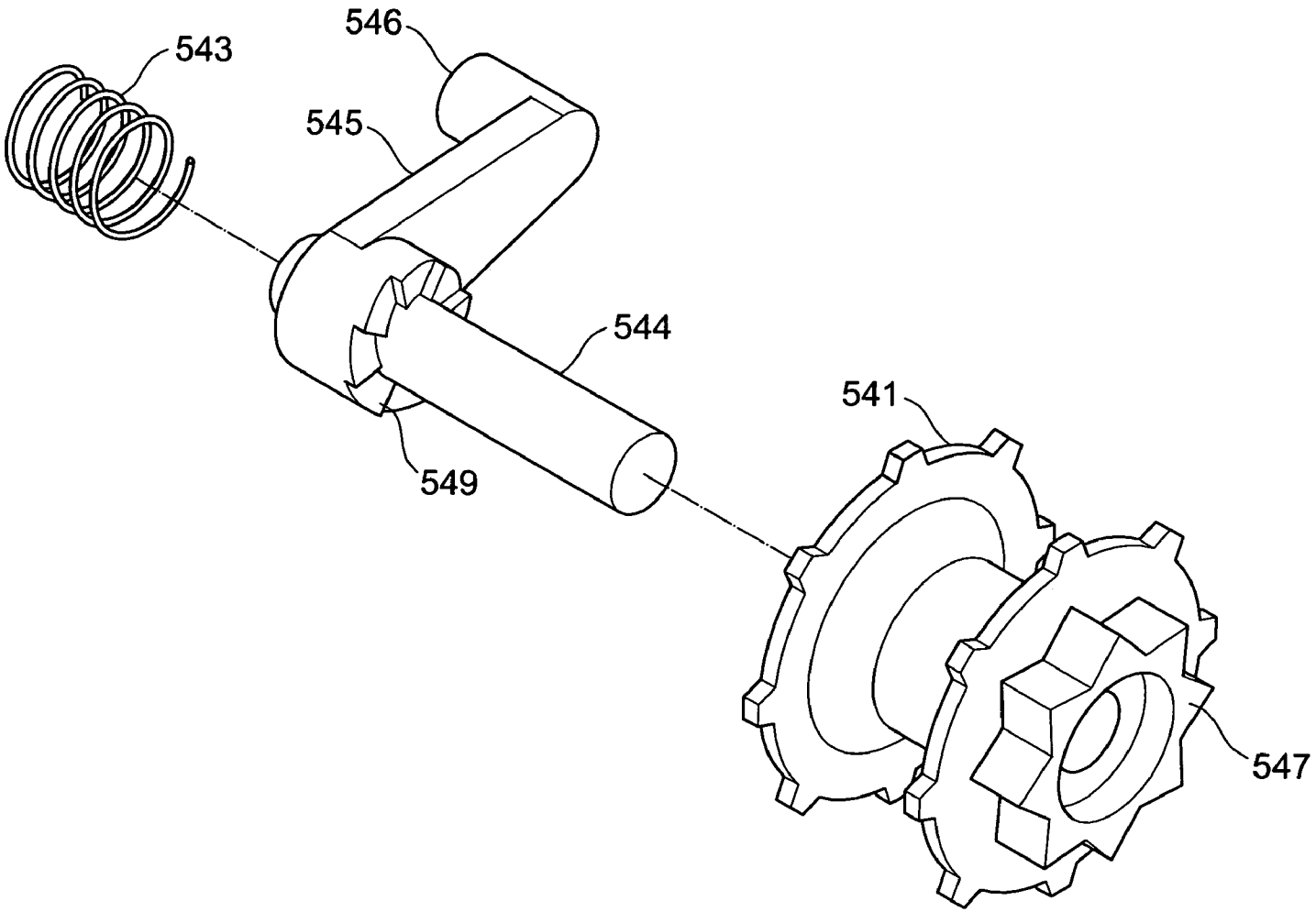
FIG. 9 is a cross-sectional view of the nail gun in FIG. 7, wherein the slide head (52) is not pressed.

As shown in FIG. 9, the compressional spring 53 is mounted between the slide head 52 and the guide mount 51 for exerting an outward pushing force on the slide head 52.

As shown in FIG. 10, the nail-belt transmission mechanism 54 is housed within the slide head 52, which comprises a transmission gear wheel 541 having an axial hole 542 for passing through a transmission axle 544 disposed between the left half 52A and the right half 52B of the slide head 52. The outer end of the transmission axle 544 is provided with a link 545 whose other end is provided with an axle 546 that bulges out of the guide slot 521 on the left half 52A. Further, the inner wall on the left half 52B aside the transmission gear wheel 541 is provided with a first unidirectional ratchet wheel 546. On the other side, there is a retaining part 548 with an extend member tilting against another ratchet wheel 547, as shown in FIG. 10.

As shown in FIG. 7, the adjustment bracket 55 is mounted in the front of the slide head 52 for adjusting the spacing between the adjustment bracket 55 and the slide head 52 for accommodating nails of different lengths.

The structure of the nail gun of the present invention is similar to that of the mail gun of the prior art. However, the present invention is characterized by the features as follows.

Figure 8:
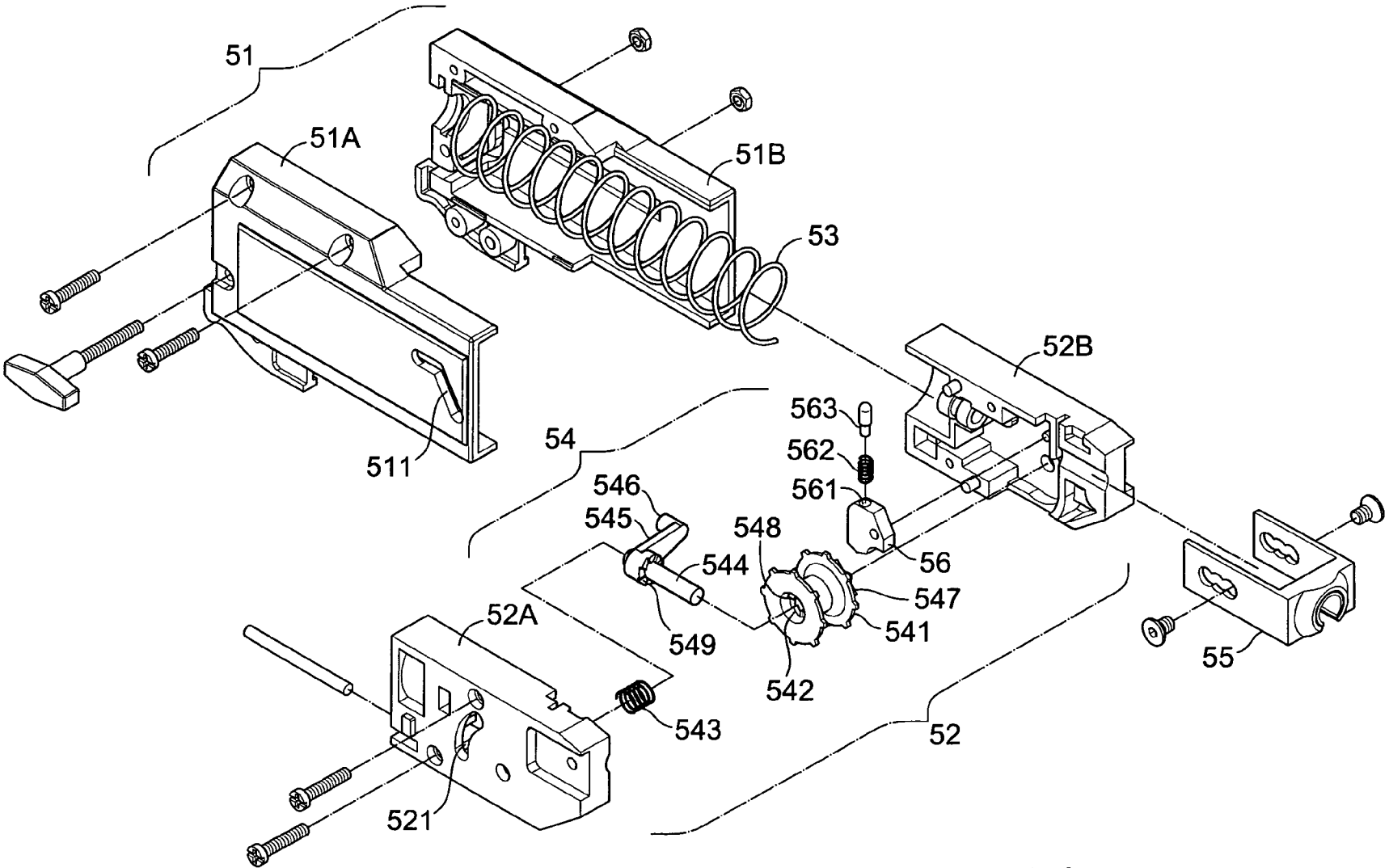
FIG. 8 is an exploded perspective view of the nail gun in FIG. 7.

As shown in FIG. 8, there are a second and a third unidirectional ratchet wheels 543A, B, each in the axial hole 542 of the transmission gear wheel 541 and on the lateral wall where the link 545 and the transmission axle 544 intersect. The second and the third unidirectional ratchet wheels 543A, B will not be engaged when a relative rotation between them is clockwise, and they will be engaged when the rotation is counter-clockwise. As shown in FIG. 9, there is a flexible unit 549 between the link 545 and the left half 522A, which is a compressional spring; thereby, the engagement between the second and the third unidirectional ratchet wheels 543A, B will be reinforced.

Therefore, the present invention has the advantages as follows.

(1) As shown in FIG. 10, since the jumped counter-clockwise rotation of the transmission gear wheel 241 is realized due to the engagement of the second and the third unidirectional ratchet wheels 543A, B, and since the teeth intervals of the second and the third unidirectional ratchet wheels 543A, B are larger than the usual, the small-distance transmission of the nail belt 60 due to uneven pushing of the slide head 52 can be avoided.

Figure 11:
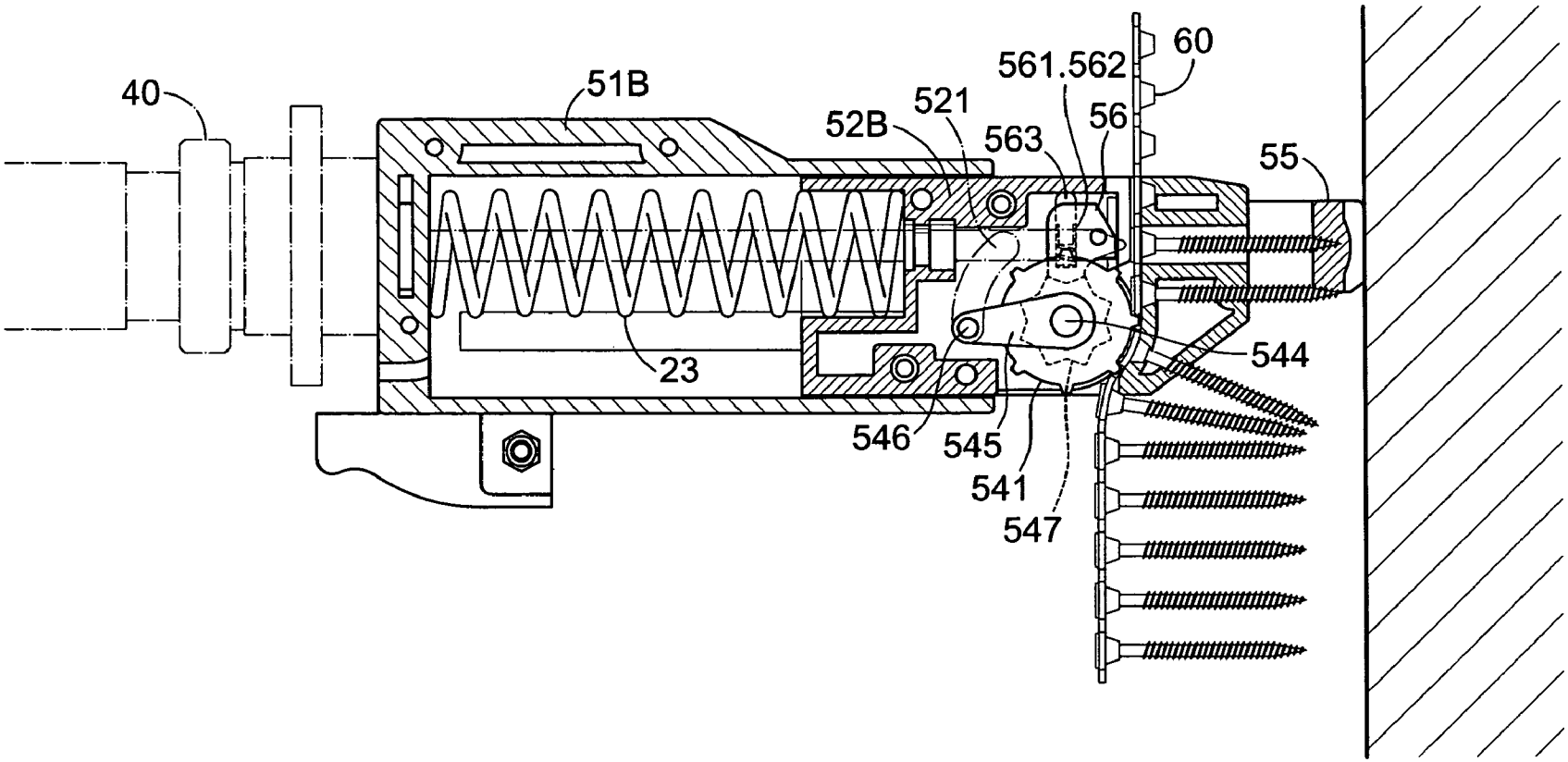
FIG. 11 is a cross-sectional view showing the configuration including the transmission gear wheel (541), the ratchet wheel (547) and the retaining part (548) of the nail gun in FIG. 7, wherein the slide head (52) is not pressed.
Figure 12:
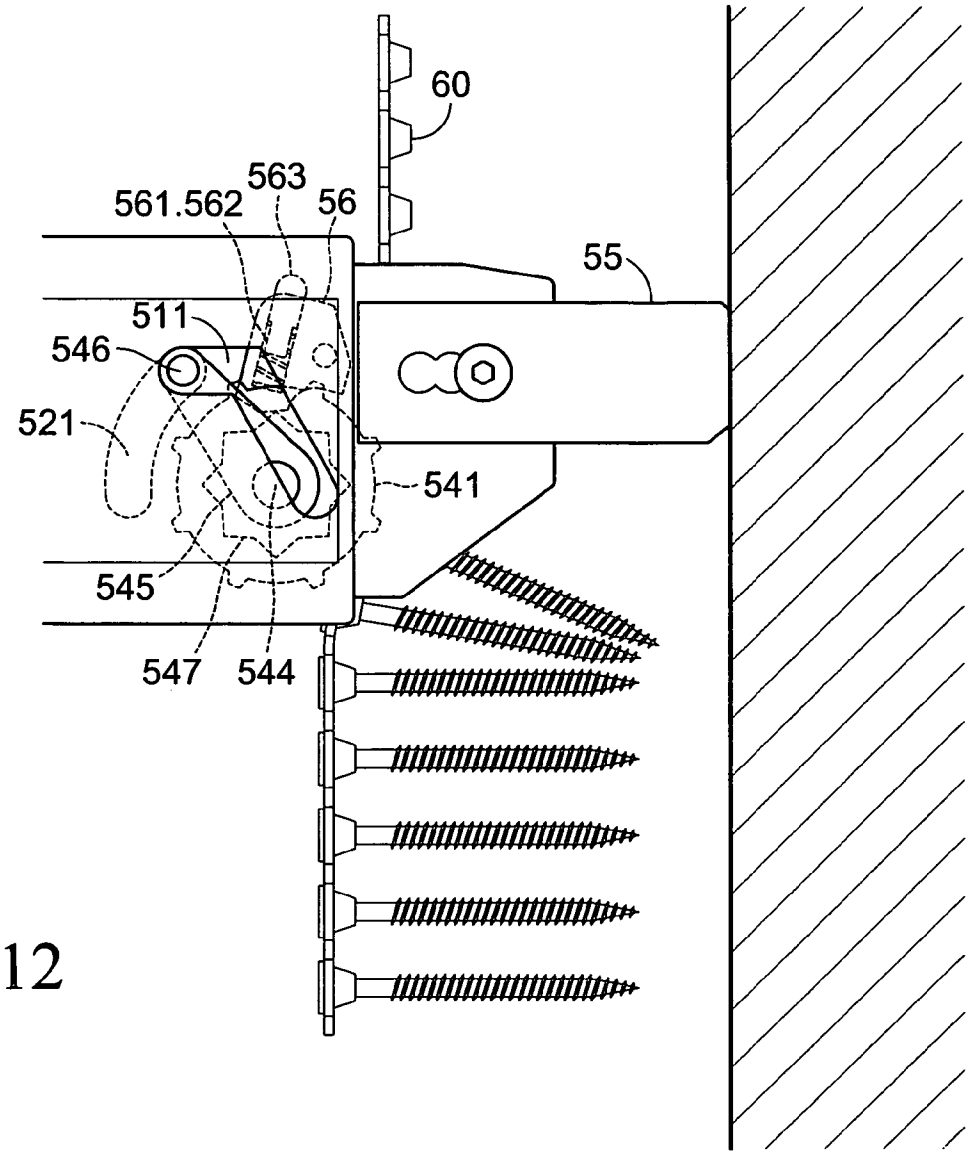
FIG. 12 is a cross-sectional view showing the configuration including the transmission gear wheel (541), the ratchet wheel (547) and the retaining part (548) of the nail gun in FIG. 7, wherein the slide head (52) is pressed.
Figure 13:
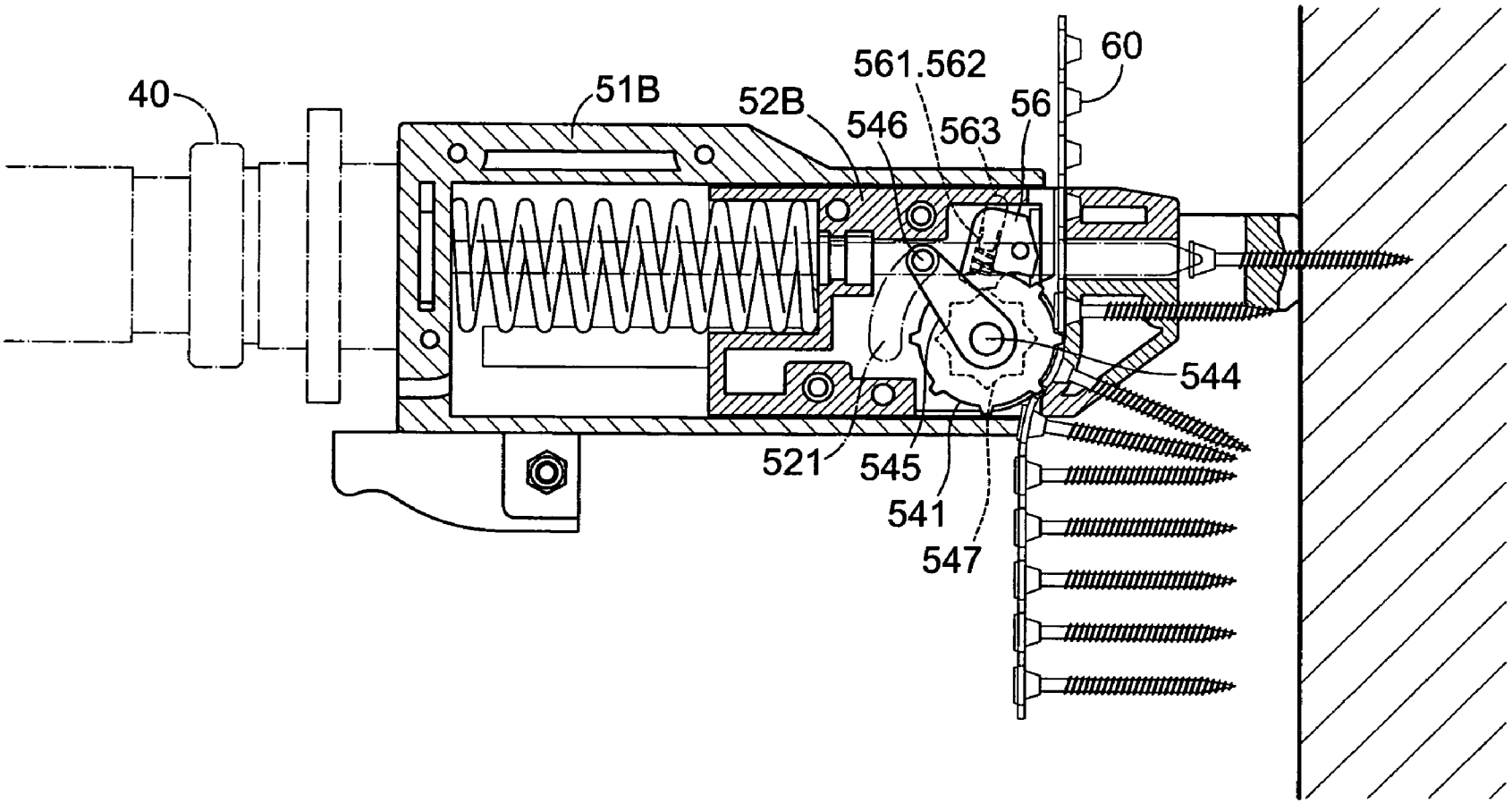
FIG. 13 is a cross-sectional view showing the operation configuration of the present invention which is identical to those illustrated in FIG. 12, but is viewed from another orientation.

(2) As shown in FIG. 11, the retaining part 248 in the present invention is a retaining block with a hole 56 in which a spring 57 and a lock pin 58 are disposed. Therefore, fatigue of the retaining part 248 is less likely. FIG. 12 is a cross-sectional view showing the configuration including the transmission gear wheel (541), the ratchet wheel (547) and the retaining part (548) of the nail gun in FIG. 7, wherein the slide head (52) is pressed. FIG. 13 is a cross-sectional view showing the operation configuration of the present invention which is identical to those illustrated in FIG. 12, but is viewed from another orientation.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nail gun, comprising:

a guide mount consisting of a left half and a right half capable of being locked on a front terminal of a gas/electricity powered driver, said left half being further provided with a guide slot;

a slide head slidably housed with in said guide mount and consisting of a left half and a right half, said left half being further provided with a guide slot;

a compressional spring disposed between said guide mount and said slide head for exerting a forward force on said slide head;

a nail-belt transmission mechanism further comprising a transmission gear wheel with an axial hole, a transmission axle inserted through said axial wheel with a link on one end thereof, a unidirectional ratchet wheel attached on a lateral wall by said transmission gear wheel and a retaining part downwardly interfering with said ratchet wheel, a free end of said link being further provided with an axle, a retaining unit being mounted on an inner wall of an opposite half of said slide head for downwardly interfering with said ratchet wheel, said retaining unit further comprising a block with a hole wherein a spring and a lock pin are disposed; and an adjustment bracket mounted in a front end of said slide head for adjusting the spacing between said adjustment bracket and said slide head for accommodating nails of different lengths;

whereby a nail belt will be fed into said driver smoothly.

* * * * *